United States Patent [19]

LeVine

[11] Patent Number: 4,714,239

[45] Date of Patent: Dec. 22, 1987

[54] SHARPENER MOUNTING CONSTRUCTION

[76] Inventor: Arthur L. LeVine, P.O. Box 800, Williamsville, N.Y. 14221

[21] Appl. No.: 837,143

[22] Filed: Mar. 7, 1986

Related U.S. Application Data

[62] Division of Ser. No. 614,685, May 29, 1984, which is a division of Ser. No. 325,758, Nov. 30, 1981, Pat. No. 4,471,951.

[51] Int. Cl.[4] ..... B24B 3/54

[52] U.S. Cl. ..... 269/3; 269/71; 269/97

[58] Field of Search ..... 76/82, 82.2, 88; 51/69, 51/166 FB, 221 BS, 221 R, 217 P, 217 A, 217 R, 170, 166 TS; 24/248.5 A, 263 A; 403/3, 4; 269/3, 4, 71, 97–98, 45, 907, 88, 900, 87.3

[56] References Cited

U.S. PATENT DOCUMENTS

| | | | |
|---|---|---|---|
| 93,031 | 7/1869 | Zimmerman . | |
| 308,046 | 11/1884 | Williams . | |
| 905,331 | 12/1908 | Larsen et al. . | |
| 945,771 | 1/1910 | Ensminger . | |
| 1,039,831 | 10/1912 | Sisson | 269/3 |
| 1,148,303 | 7/1915 | Farrar . | |
| 1,368,218 | 2/1921 | Chenette . | |
| 1,601,339 | 9/1926 | Ballou . | |
| 1,681,763 | 8/1928 | Eaton . | |
| 1,806,234 | 5/1931 | Boyd . | |
| 1,832,968 | 11/1931 | DeArmey . | |
| 2,012,513 | 8/1935 | Maze . | |
| 2,082,755 | 6/1937 | Polney . | |
| 2,116,343 | 5/1938 | Davis . | |
| 2,157,816 | 5/1939 | Carosi . | |
| 2,536,279 | 1/1951 | Grube . | |
| 2,586,636 | 2/1952 | Fischer et al. . | |
| 2,731,863 | 1/1956 | Bellows . | |
| 3,819,170 | 6/1974 | Longbrake . | |
| 4,137,003 | 1/1979 | Budoff | 269/87.3 |
| 4,320,892 | 3/1982 | Longbrake . | |
| 4,404,873 | 9/1983 | Radish | 269/3 |

*Primary Examiner*—Robert C. Watson

*Attorney, Agent, or Firm*—Joseph P. Gastel

[57] ABSTRACT

A sharpener mounting construction for sharpening opposite sides of a knife edge including a sharpener body for clamping a knife, opposite sides on the sharpener body, bores on opposite sides of the sharpener body, a post, and a pin at the end of the post, the pin being of a diameter to fit snugly within the bores whereby the sharpener body may be mounted on the post in one attitude and thereafter the sharpener body can be inverted and mounted on the post in an inverted attitude. The posts in turn may be threadably mounted on a plate or detachably mounted on a C-clamp in a plurality of attitudes.

5 Claims, 19 Drawing Figures

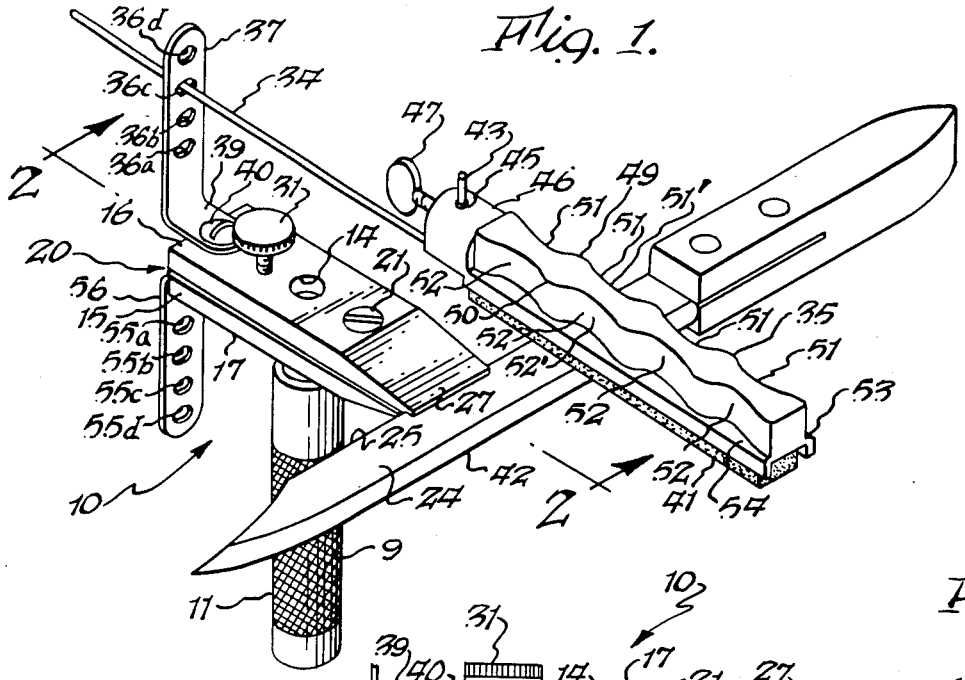
Fig. 1.
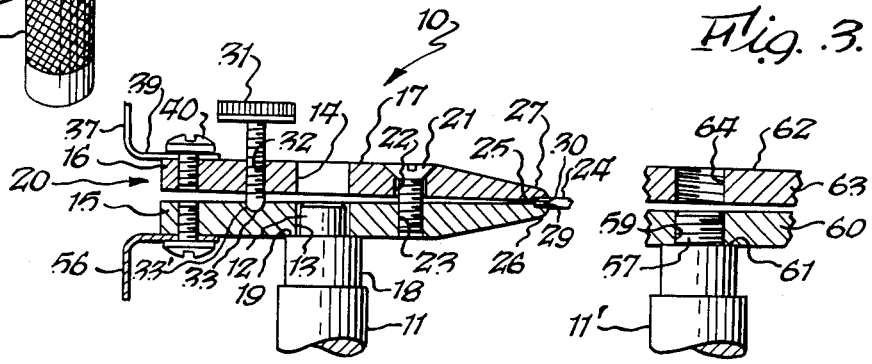
Fig. 3.
Fig. 4.
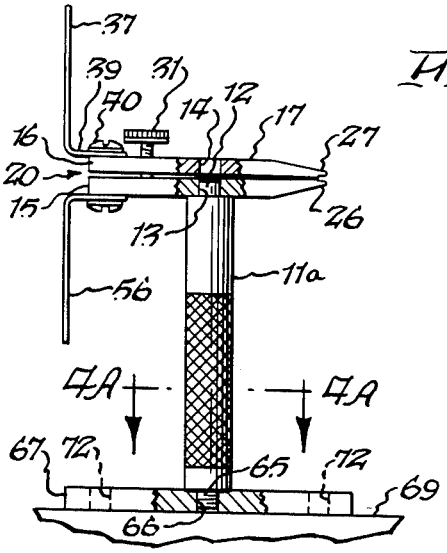
Fig. 2.
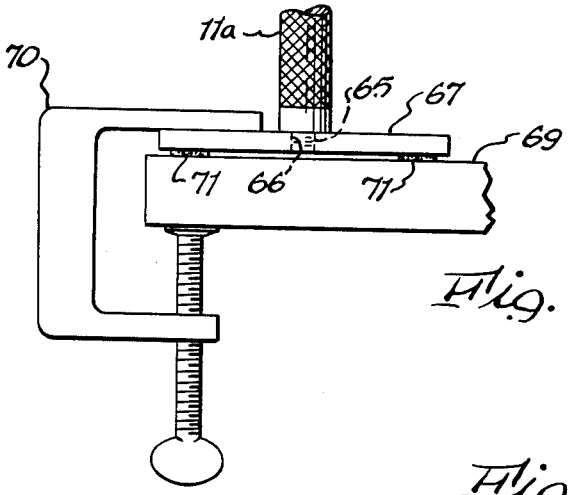
Fig. 5.
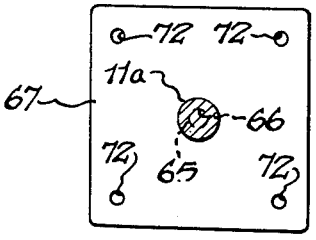
Fig. 4A.
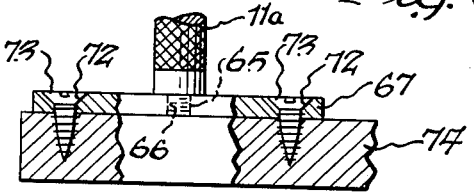
Fig. 6.

Fig. 7.
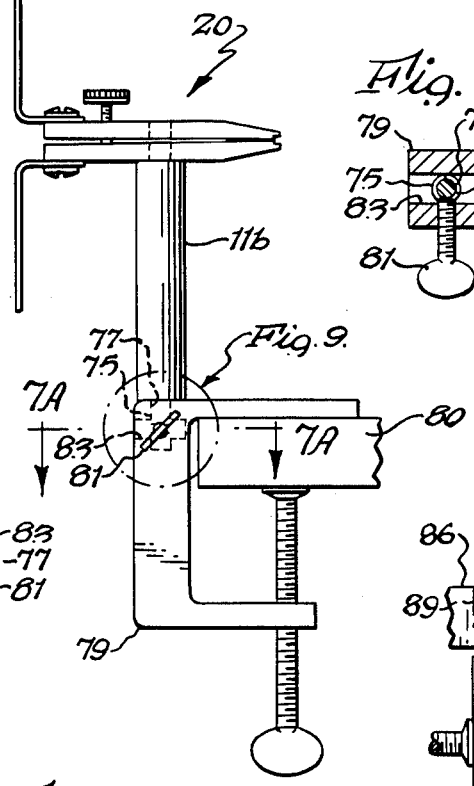
Fig. 7A.
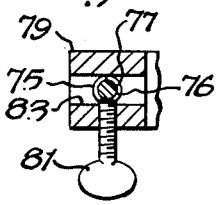
Fig. 10.
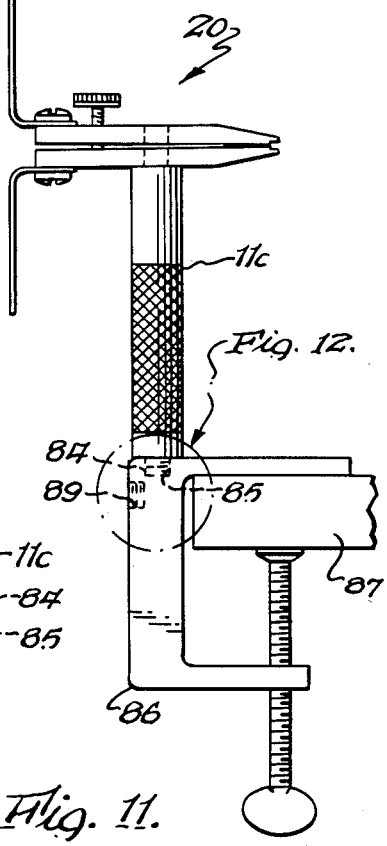
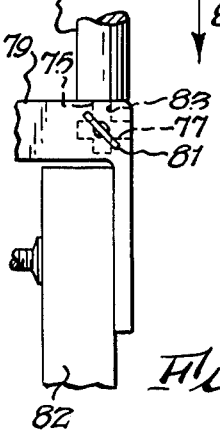
Fig. 8.
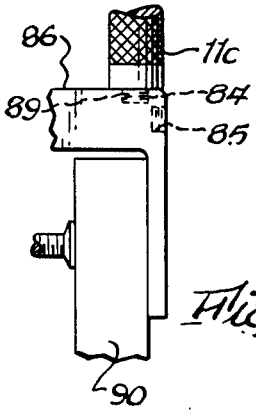
Fig. 11.
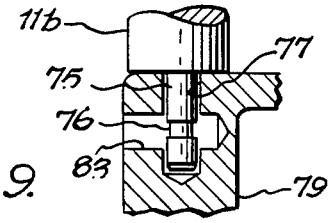
Fig. 9.
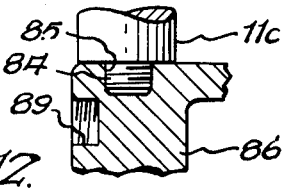
Fig. 12.
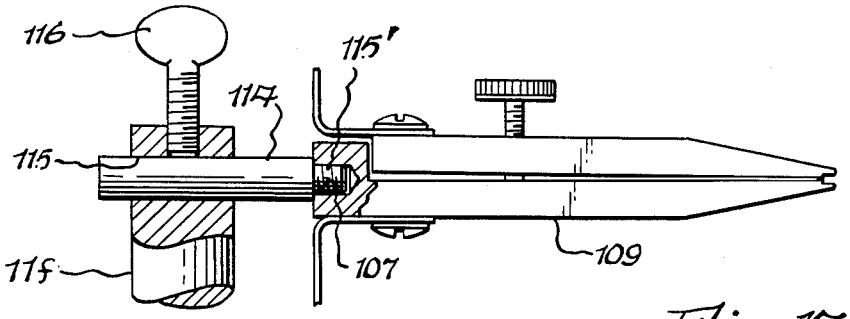
Fig. 17.

Fig. 13.
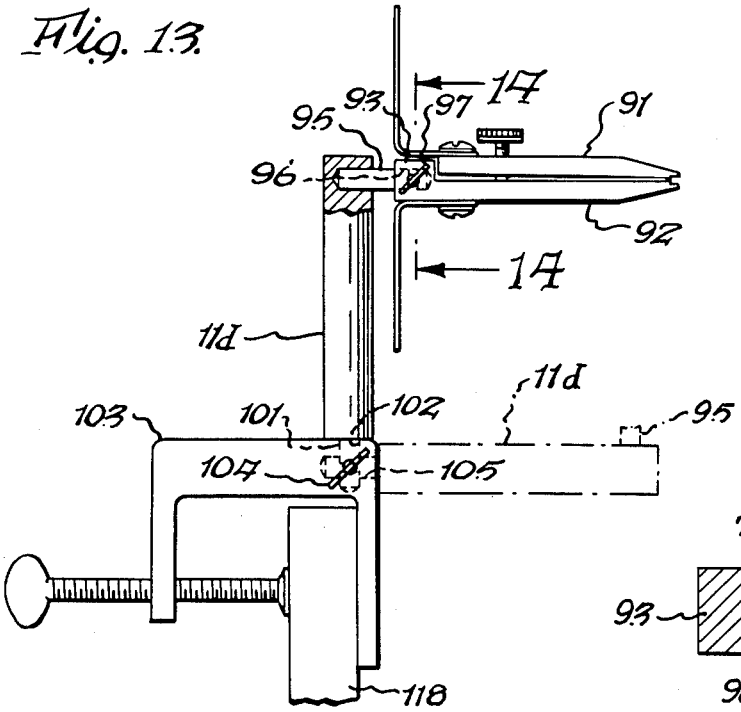
Fig. 14.
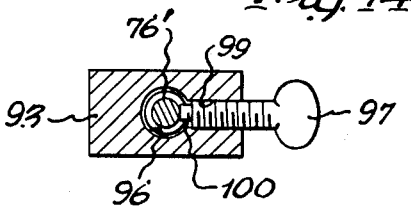
Fig. 15.
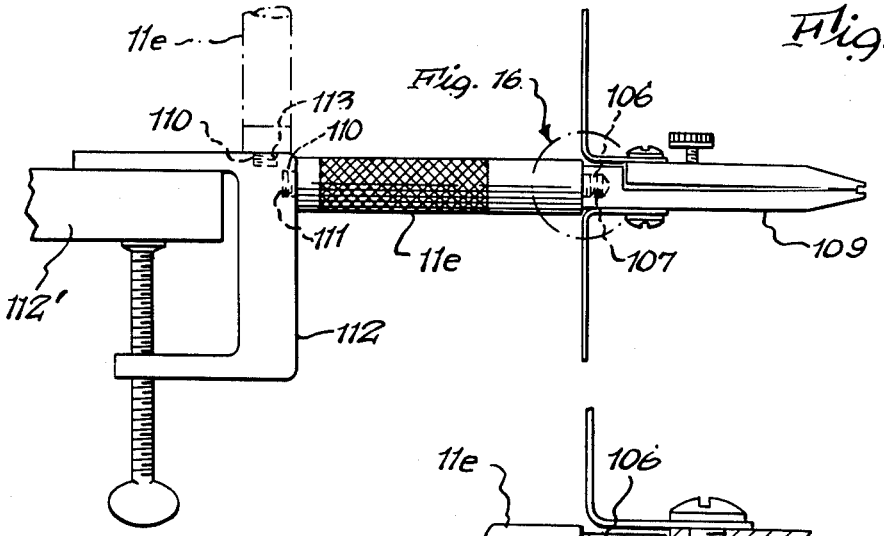
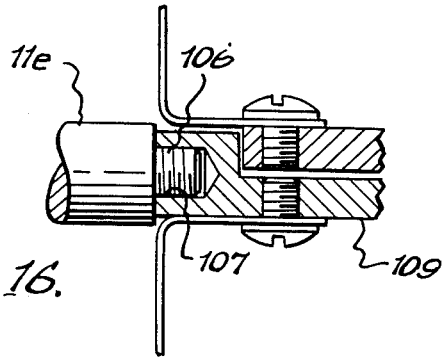
Fig. 16.

SHARPENER MOUNTING CONSTRUCTION

This is division of application Ser. No. 614,685 filed May 29, 1984, which is a division of application Ser. No. 325,758, filed Nov. 30, 1981, now U.S. Pat. No. 4,471,951.

BACKGROUND OF THE INVENTION

The present invention relates to an improved sharpener mounting construction.

By way of background, knife sharpeners of the type shown in U.S. Pat. No. 3,819,170 are known. A sharpener of this type includes a sharpener body having a pair of clamp members which clamp the rear edge of a knife. Guides are attached to the clamp members for guiding a sharpening stone at a predetermined angle relative to the knife blade. In the past, sharpeners of the foregoing type were held directly in the hand, and thus had certain drawbacks, namely, that the hand holding the clamp members could not get a good grip on them, which resulted in the sharpener being held in an unstable manner. In order to overcome the foregoing deficiencies, a C-clamp type of mounting having an upstanding post was developed, with the sharpener being mounted on a post by an extremely complex bracket. It is with overcoming the foregoing deficiencies of the prior art that the present invention is concerned.

SUMMARY OF THE INVENTION

It is one object of the present invention to provide an extremely simple improved holder for a knife sharpener which mounts the knife sharpener in a stable manner.

Another object of the present invention is to provide an improved holder for a knife sharpener which can be attached to a C-clamp or a mounting plate in an extremely simple and expedient manner. Other objects and attendant advantages of the present invention will readily be perceived hereafter.

The present invention relates to a sharpener mounting construction for sharpening a knife edge comprising a sharpener body including a pair of clamp members for clamping a knife, a post, a pin on the post, and bore means in said sharpener body for receiving said pin.

The various aspects of the present invention will be more fully understood when the following portions of the specification are read in conjunction with the accompanying drawings wherein:

BRIEF DESCRIPTION OF THE DRAWINGS

FIG. 1 is a perspective view showing the sharpener mounting construction of the present invention supporting a sharpener and showing a sharpening stone and holder in position for sharpening a knife;

FIG. 2 is a fragmentary cross sectional view taken substantially along line 2—2 of FIG. 1;

FIG. 3 is a fragmentary view of a portion of FIG. 2 and showing an alternate embodiment of the mounting post;

FIG. 4 is a side elevational view, partially in cross section, showing a modified sharpener mounting construction;

FIG. 4A is a cross sectional view taken substantially along line 4A—4A of FIG. 4;

FIG. 5 is a fragmentary side elevational view showing how the embodiment of FIG. 4 may be secured to a table top;

FIG. 6 is a fragmentary cross sectional view similar to FIG. 5 showing another way of securing the embodiment of FIG. 4 to a table top;

FIG. 7 is a fragmentary side elevational view showing how the sharpener mounting construction may be mounted on a C-clamp which is secured to a horizontal member, such as a table top;

FIG. 7A is a cross sectional view taken substantially along line 7A—7A of FIG. 7;

FIG. 8 is a fragmentary side elevational view showing how the sharpener may be mounted on a C-clamp which is secured to a vertical surface, such as the back of a chair;

FIG. 9 is an enlarged fragmentary view of the portion of FIG. 7 within the circle captioned FIG. 9;

FIG. 10 is a fragmentary side elevational view of a modified embodiment of the structure shown in FIG. 7 mounted on a C-clamp secured to a horizontal table top;

FIG. 11 is a fragmentary side elevational view showing how the mounting construction of FIG. 10 may be secured to a C-clamp mounted on a vertical surface, such as the back of a chair;

FIG. 12 is an enlarged fragmentary view, partially in cross section, of the encircled portion of FIG. 10 which is designated FIG. 12;

FIG. 13 is a fragmentary side elevational view, partially in cross section, showing a modified form of sharpener body and a modified form of mounting construction therefor;

FIG. 14 is a cross sectional view taken substantially along line 14—14 of FIG. 13;

FIG. 15 is a modified embodiment of the mounting construction of FIG. 13;

FIG. 16 is a fragmentary enlarged view of the portion of FIG. 15 within the circle designated FIG. 16; and FIG. 17 is a modified form of the mounting construction for the sharpener body of FIG. 15.

DESCRIPTION OF THE PREFERRED EMBODIMENTS

The improved sharpener mounting construction 10 essentially consists of a post 11 having a knurled portion 9 and an integral pin 12 at the end thereof which fits snugly into bore 13 or 14 of clamp member 15 or 16, respectively, of sharpener body 17 of sharpener 20 to provide a person with a better grip relative to the sharpener body 17 when a knife is being sharpened. In use, a person generally grasps the post 11 with the last three fingers and holds the sharpener body 17 between his thumb and forefinger. Post 11 includes a reduced portion 18 having an annular shoulder 19 at its upper end which bears against the immediately contiguous underside of clamp member 15, as shown in FIG. 2. The combination of pin 12 and shoulder 19 stabilize the sharpener when it is being held. The sharpener 20 itself, exclusive of the bores 13 and 14 and exclusive of post 11, does not constitute any part of the present invention.

The sharpener 20 may be identical to the sharpener disclosed in copending application Ser. No. 325,757, filed on even date herewith, now abandoned, which is an improvement over the sharpener disclosed in U.S. Pat. No. 3,819,170. The sharpener 20, as noted above, includes contiguous clamp members 15 and 16 which are secured to each other by a screw 21 which passes through enlarged bore 22 in member 16 and is threadably received in tapped bore 23 of member 15. Clamp members have inner sides (not numbered) which face each other, and they also have outer sides (not numbered) which face away from each other. When a knife 24 is to be sharpened, its rear edge 25 is placed between jaws 26 and 27 with the rear edge of the knife abutting shoulders 29 and 30. Screw 21 is adjusted with a screwdriver or a dime to clamp the rear edge 25 reasonably securely. Thereafter, thumb screw 31, which is threadably mounted in tapped bore 32 of member 16, is tightened to cause its end 33 to be received in and bear against a dimple 33' in the upper surface of member 15, and this will pivot member 16 about the axis of screw 21 to provide a greater clamping force on the rear edge 25 of the knife. Dimple 33' aids in preventing sidewise movement of clamp members 15 and 16 relative to each other.

Pin 12, which is received in bore 13 with a sliding fit, has a length which is not substantially greater than the thickness of member 15. If it were longer and if it extended into bore 14, when screw 31 was tightened to cock member 16, there could be binding between pin 12 and bore 14. By making pin 12 sufficiently short so that it does not enter bore 14, binding is obviated. Pin 12 is inserted into bore 13 from the outer side of clamp member 15.

After the knife 24 has been clamped, it can be sharpened while post 11 and sharpener body 17 are held in the above-described manner. Sharpener 20 includes a rod 34, which is attached to sharpening stone holder 35 on which sharpening stone 41 is mounted. Rod 34 is inserted through one of the apertures **36*a* or 36*b* or 36*c* or 36*d* of upstanding guide bracket 37 which has a foot portion 39 attached to clamp member 16 by means of screw 40. The sharpening stone 41 is then caused to move across the knife edge 42 to be sharpened. This motion is a compound one which is both transverse and longitudinal of knife blade 24. The guide rod 34 maintains the angle of stone 41 constant throughout the sharpening operation, and the angle applied to edge 42 is determined by the aperture in guide bracket 37 through which guide rod 34** is inserted.

The guide rod 34 is secured to holder 35 by means of guide rod end portion 43 which is a continuation of portion 34 and extends substantially perpendicularly thereto. Rod end 43 is received in a bore 45 in the end portion 46 of holder 35 and is secured therein by means of a thumb screw 47 which is threadably received in portion 46 and bears against guide rod portion 43. Holder 35 includes two opposite undulating surfaces 49 and 50 each containing a plurality of concavities 51 and 52, respectively. A right-handed person would place four fingers along concavities 51 and this thumb in the second concavity 52 which is also designated 52'. A left-handed person would place his four fingers into concavities 52 and his thumb in the concavity 51 which is also designated 51'. The ends of the fingers and the thumb rest againt the flanges 53 and 54 which are molded integrally with the stone holder. The construction of the stone holder forms the subject matter of copending application Ser. No. 325,757, filed of even date herewith, now abandoned.

After one edge of knife 24 has been sharpened, all that is necessary to be done to sharpen the other edge is to remove guide rod 34 from the hole **36*c* in which it is located, remove the pin 11 from bore 13, invert the sharpener body 17 180°, insert pin 12 into bore 14 from the outer side of clamp member 16, and thereafter insert the rod 34 into aperture 55*c* of guide member 56 which is attached to clamp member 15 by a screw which is analogous to screw 40. Guide member 56 is a mirror image counterpart of guide member 37. The reason that rod 34 is inserted into aperture 55*c* is because this will give the same angle to the opposite side of knife edge 42 as was obtained by inserting rod 34 in aperture 36*c*. However, for different types of knives different edge angles are desired and this is the reason for having the series of apertures 36*a–d* and 55*a–d***.

An alternate embodiment of the present invention is shown in FIG. 3 wherein post 11', which is analogous to post 11, has a pin with a threaded end 56 which is received in tapped bore 59 of clamp member 60, which may be identical in all other respects to clamp member 15. Upon tightening of threaded end 57 into bore 59, clamp member 60 will come to rest against annular shoulder 61. By this construction a good firm post connection to clamp member 60 is obtained. As with the previous embodiment, after one side of the knife edge has been sharpened in the above described manner, threaded end 57 is unscrewed from bore 59, the sharpener body 62 is inverted and threaded end 57 is threaded into clamp member 63, which is identical in all respects to clamp member 16 of the preceding figures, except for the threaded bore 64 which receives threaded end 57.

In FIG. 4 a further embodiment of the present invention is disclosed. Post **11*a* may be identical in all respects to the posts of FIGS. 1 or 3 and the sharpener body supported by the posts may be identical to the sharpener bodies of FIGS. 1 or 3. Post 11*a* differs from post 11 and 11' of FIGS. 1 and 3 by having a threaded end 65 which is received in tapped bore 66 of plate 67 which rests on a table top 69. As shown in FIG. 4, there is no connection between table top 69 and plate 67 but the table top provides good support to plate 67 which in turn firmly supports post 11*a* which in turn firmly supports the sharpener body 20. In use, post 11*a* is grasped in any desired manner while plate 67 bears on the table top. If desired, plate 67 may be clamped to the table 69 by means of a C-clamp 70 as shown in FIG. 5. Pads 7 may be supplied on the underside of plate 67. Plate 67 may have screw holes 72 therein for receiving screws 73 to firmly secure plate 67 to a workbench 74**.

In FIGS. 7–9 a modified form of mounting construction is shown. The sharpener 20 may be identical to that disclosed in FIGS. 1 or 3. The post **11*b* varies only from those shown in FIGS. 1, 3 and 4 in that the lower end is formed into a pin 75 having a reduced diameter portion 76. Pin 75 is received in a bore 77 of C-clamp 79 which is attached to a table top 80. A thumb screw 81 is threadably received in C-clamp body 79 and bears against the reduced diameter portion 76. If it is desired to mount the C-clamp 79 on a vertical member 82, such as the back of a chair, and if it is desired to maintain post 11*b* in a vertical attitude, it is merely necessary to remove pin 75 from bore 77 and insert it into bore 83 which extends at right angles to bore 77, and thereafter tighten thumb screw 81, as shown in FIG. 8**.

In FIGS. 10–12 a further embodiment of the present invention is shown. In this embodiment knife sharpener 20 may be identical to those shown in FIGS. 1 or 3. Post **11*c* varies from post 11*b* in that it has a threaded reduced diameter end 84 which can be received in tapped bore 85 of C-clamp 86 in the event the latter is mounted on a horizontal member 87 or it may be received in tapped bore 89 of C-clamp 86 in the event the latter is mounted on a vertical member 90**.

In FIGS. 13 and 14 a further embodiment of the present invention is disclosed wherein sharpener body 91 is of a different construction than sharpener body 17.

The difference resides in the fact that the lower clamp member 92 has a block 93 formed at the end remote from the end which clamps the knife. Otherwise, the structure may be identical to the structure described above relative to FIGS. 1 and 2, except for the pin-receiving holes 13 and 14. The post **11*d* includes a horizontal pin member 95 having an axis which extends transversely to the longitudinal axis of post 11*d*. The outer end of pin 95 is of the same shape as pin 75 of FIG. 9. The outer end of pin 95 is received in bore 96 of block 93 and a thumb screw 97, which is threaded into bore 99, has an end 100 which bears against the reduced diameter portion 76' which is analogous to portion 76 of FIG. 9. The lower end of post 11*d* includes a pin 101 which is identical in construction to pin 75 of FIG. 9 and which is received in a bore 102 in C-clamp 103 and is secured therein by means of thumb screw 104 of the type described above relative to FIG. 7A. If C-clamp 103 is mounted on a horizontal body 87, such as shown in FIG. 10, then pin 101 is inserted into bore 105 and thumb screw 104** is tightened.

A further modified form of post 11e is shown in FIGS. 15 and 16 wherein the post has a threaded reduced end 106 which is received in tapped bore 107 of sharpener body 109 which may otherwise be identical to sharpener body 91. The opposite end of post **11*e* has a threaded reduced diameter portion 110 which is received in either tapped bore 111 of clamp 112 or tapped bore 113, depending on how the C-clamp 112 is attached to the supporting body and depending on the desired orientation of post 11*e*. Generally, bore 111 will be used if the mounting of C-clamp 112 is on a horizontal body 112', and bore 113 will be used if C-clamp 112 is mounted on a vertical body, such as 118 of FIG. 13**.

A still further embodiment is disclosed in FIG. 17 wherein sharpener body 109 may be identical in all respects to that disclosed in FIG. 16. However, the attachment to post 11f is by means of a post 114 which has its end 115' threaded into tapped bore 107 and which is received in bore 115 of post **11*f* and secured therein by means of thumb screw 116**.

It will be appreciated that in every embodiment described above the sharpener body may be inverted 180° after the first side of the knife edge has been sharpened, so that access may be had to the other side of the knife edge. The inversion is achieved by either demounting the sharpener body from the pin (plain or threaded) and thereafter remounting it in an inverted position, as in the embodiments of FIGS. 1 and 3, or by loosening the thumb screw which secures the sharpener body to the post and pivoting the sharpener body 180°, as in the embodiments of FIGS. 13 and 17, or by merely unthreading the sharpener slightly from the post to rotate the sharpener body 180°, as in the embodiment of FIG. 15.

While preferred embodiments of the present invention have been disclosed, it will be appreciated that the present invention is not limited thereto, but may be otherwise embodied within the scope of the following claims.

What is claimed is:

1. A sharpener clamp construction for mounting on a mounting post comprising a sharpener body including first and second contiguous clamp members for clamping a knife, end portions on said first and second contiguous clamp members, first and second knife clamping means on said end portions of said first and second knife clamping members, respectively, inner and outer opposite sides on each of said first and second clamp members, said inner sides facing each other and said outer sides facing away from each other, first and second mounting post receiving bore means extending inwardly into each of said first and second clamp members, respectively, from said outer sides toward said inner sides for receiving the end of said mounting post for mounting said sharpener clamp construction on said end of said mounting post in two orientations 180° displaced from each other, and securing means for securing said first and second clamp members in assembled relationship.

2. A sharpener clamp construction as set forth in claim 1 wherein said securing means comprise a screw extending through one of said clamp members and received in threaded relationship in the other of said clamp members.

3. A sharpener clamp construction as set forth in claim 1 wherein said first and second clamp members include second end portions remote from said first end portions, and first and second sharpener stone guiding means mounted on said first and second clamp members, respectively, at said second end portions.

4. A sharpener clamp construction as set forth in claim 3 wherein said first and second knife clamping means extend in opposite directions away from said outer sides.

5. A sharpener clamp construction as set forth in claim 1 wherein said first and second mounting post receiving bore means are in axial alignment with each other so that said knife clamping means on said first and second clamp members are always located at the same distance from said mounting post in both of said orientations which are 180° displaced from each other.

* * * * *